US007642840B2

(12) United States Patent
Kurata et al.

(10) Patent No.: US 7,642,840 B2
(45) Date of Patent: Jan. 5, 2010

(54) REFERENCE VOLTAGE GENERATOR CIRCUIT

(75) Inventors: Hajime Kurata, Kawasaki (JP); Kunihiko Gotoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 156 days.

(21) Appl. No.: 11/892,209

(22) Filed: Aug. 21, 2007

(65) Prior Publication Data

US 2007/0290669 A1 Dec. 20, 2007

Related U.S. Application Data

(63) Continuation of application No. PCT/JP2005/002987, filed on Feb. 24, 2005.

(51) Int. Cl.
*G05F 3/02* (2006.01)

(52) U.S. Cl. ..... 327/538

(58) Field of Classification Search ..... 327/538–543
See application file for complete search history.

(56) References Cited

U.S. PATENT DOCUMENTS 5,272,392 A 12/1993 Wong et al.
5,861,771 A * 1/1999 Matsuda et al. ..... 327/540
6,313,515 B1 11/2001 Takiguchi
6,400,212 B1 6/2002 Sakurai
7,193,454 B1 * 3/2007 Marinca ..... 327/539
2007/0052473 A1 * 3/2007 McLeod ..... 327/539

FOREIGN PATENT DOCUMENTS

| | | | |
|---|---|---|---|
| EP | 0 973 200 | A1 | 1/2000 |
| JP | 2-157917 | | 6/1990 |
| JP | 02145005 | A | 6/1990 |
| JP | 06250751 | A | 9/1994 |
| JP | 11-121694 | | 4/1999 |
| JP | 2000-035827 | | 2/2000 |
| JP | 2004-341877 | | 12/2004 |

* cited by examiner

*Primary Examiner*—Lincoln Donovan
*Assistant Examiner*—William Hernandez
(74) *Attorney, Agent, or Firm*—Arent Fox LLP

(57) ABSTRACT

A reference voltage generator circuit is provided which is capable of stable generation of a reference voltage. A differential amplifier circuit has a non-inverting input terminal input with the voltage Vbe1 generated by a PNP transistor Q1 and an inverting input terminal input with an output signal thereof. A differential amplifier circuit has a non-inverting input terminal input with the voltage Vbe2 generated by a PNP transistor Q2 and an inverting input terminal input with the output signal of the differential amplifier circuit through a resistor R1 and also input with an output signal thereof through a resistor R2, to generate a reference voltage Vref.

5 Claims, 8 Drawing Sheets

REFERENCE VOLTAGE GENERATOR CIRCUIT

This application is a continuing application, filed under 35 U.S.C. § 111(a), of International Application PCT/JP2005/002987, filed Feb. 24, 2005.

BACKGROUND

1. Field

The embodiment relates to reference voltage generator circuits, and more particularly, to a reference voltage generator circuit using a pair of PN junction devices with different current densities to generate a temperature-independent reference voltage.

2. Description of the Related Art

As a result of the recent tendency toward further reduction in size and increased portability of various systems, there has been a demand for reference voltage generator circuits capable of supplying a low, stable reference voltage to semiconductor integrated circuits. Such reference voltage generator circuits are needed especially for semiconductor integrated circuits used in IC (Integrated Circuit) cards or ID (Identification) chips which are generally not equipped with a power supply. Semiconductor integrated circuits used in these applications derive electric power from the energy of radio waves irradiated for the purpose of access and operate with a reference voltage generated from the derived power. Accordingly, if a low, stable reference voltage can be generated, then it is possible to attain a wider communicable range.

Typical reference voltage generator circuits popular in recent years utilize the energy band-gap of silicon PN junction and are referred to also as band-gap reference circuits.

The following describe exemplary reference voltage generator circuits disclosed in Japanese Unexamined Patent Publication No. 2000-35827 (paragraph nos. [0041] to and [0099] to [0118], FIGS. 1 and 2), by way of example.

FIGS. 7 and 8 are circuit diagrams each exemplifying a conventional reference voltage generator circuit.

The conventional reference voltage generator circuit shown in FIG. 7 includes two PNP bipolar transistors (hereinafter referred to merely as PNP transistors) Q10 and Q11 of which the collectors are connected to their respective bases (diode connection) and which have respective different current densities, resistors R10, R11 and R12, a differential amplifier circuit 11, and a start-up circuit 12. Each of the PNP transistors Q10 and Q11 has its collector and base connected to a ground terminal GND. The emitter of the PNP transistor Q10 is connected to the series-connected resistors R10 and R11, and the emitter of the PNP transistor Q11 is connected to the resistor R12. The other end of the resistor R11 is connected to the other end of the resistor R12. The resistors R11 and R12 have the same resistance value. The differential amplifier circuit 11 has an inverting input terminal (−) connected to the node between the resistors R10 and R11 and has a non-inverting input terminal (+) connected to the node between the resistor R12 and the emitter of the PNP transistor Q11. The output terminal of the differential amplifier circuit 11 is connected to the respective other ends of the resistors R11 and R12. The start-up circuit 12 is connected between the output terminal and non-inverting input terminal of the differential amplifier circuit 11.

In the reference voltage generator circuit configured as described above, feedback control is performed so as to make the potentials of the inverting and non-inverting input terminals of the differential amplifier circuit 11 equal to each other, thereby canceling out the temperature dependences (about −2.0 mV per ° C.) of the base-emitter voltages Vbe3 and Vbe4 of the PNP transistors Q10 and Q11 to allow a temperature-independent, stable reference voltage of about 1.25 V to be output from a terminal 13. Also, the reference voltage generator circuit is started by the start-up circuit 12 so as to prevent the input and output voltages of the differential amplifier circuit 11 from being fixed at 0 V due to the feedback control.

On the other hand, the conventional reference voltage generator circuit shown in FIG. 8 includes p-channel MOS (Metal-Oxide Semiconductor) field-effect transistors (hereinafter referred to as PMOS transistors) MP50, MP51 and MP52, n-channel MOS field-effect transistors (hereinafter referred to as NMOS transistors) MN50 and MN51, three PNP transistors Q12, Q13 and Q14 of which the collectors are connected to their respective bases, resistors R13 and R14, and a start-up circuit 14.

The PMOS transistors MP50, MP51 and MP52 have a common gate connected to the drain of the PMOS transistor MP51 and a common source connected to a power supply line Vdd. The drain of the PMOS transistor MP50 is connected to the drain of the NMOS transistor MN50, and the drain of the PMOS transistor MP51 is connected to the drain of the NMOS transistor MN51. The NMOS transistors MN50 and MN51 have a common gate connected to the drain of the NMOS transistor MN50. The source of the NMOS transistor MN50 is connected to the emitter of the PNP transistor Q12, and the source of the NMOS transistor MN51 is connected through the resistor R13 to the emitter of the PNP transistor Q13. The drain of the PMOS transistor MP52 is connected through the resistor R14 to the emitter of the PNP transistor Q14. Each of the PNP transistors Q12, Q13 and Q14 has its collector and base connected to a ground terminal GND. The start-up circuit 14 is connected between the common source of the PMOS transistors MP50, MP51 and MP52 and the drain of the PMOS transistor MP52. A reference voltage output terminal 15 is connected to the drain of the PMOS transistor MP52.

The PMOS transistors MP50, MP51 and MP52 are of the same size and constitute a current mirror circuit, and by virtue of a constant current flowing to the resistor R14 and the PNP transistor Q14, a stable reference voltage of about 1.25 V can be output from the terminal 15. In this reference voltage generator circuit, the PMOS transistors MP50 and MP51 are respectively connected in series with the NMOS transistors MN50 and MN51, thereby suppressing dependence on the supply voltage and enabling the supply of a highly accurate constant current. Also, the reference voltage generator circuit is started by the start-up circuit 14 so as to prevent the output voltage from being fixed at a stable point other than the reference voltage.

Meanwhile, a bias circuit for use in a reference voltage generator circuit and capable of lessening the supply voltage dependence is disclosed, for example, in Examined Japanese Patent Publication No. H07-27424 (FIGS. 1 and 3).

SUMMARY

The embodiment provides that a reference voltage generator circuit using a pair of PN junction devices with different current densities to generate a temperature-independent reference voltage, the reference voltage generator circuit including a first differential amplifier circuit having a non-inverting input terminal input with a voltage generated by one of the PN junction devices, and an inverting input terminal input with an output signal of the first differential amplifier circuit, and a second differential amplifier circuit having a non-inverting input terminal input with a voltage generated by the other of the PN junction devices, and an inverting input terminal input with the output signal of the first differential amplifier circuit through a first resistor and also input with an output signal of the second differential amplifier circuit through a second resistor, to generate the reference voltage.

DETAILED DESCRIPTION OF THE EMBODIMENTS

The start-up circuit provided in each of the conventional reference voltage generator circuits is used, however, simply to start the reference voltage generator circuit and remains useless after the start-up, and a problem also arises in that the start-up circuit makes the circuit operation unstable.

Further, the reference voltage generator circuit using the start-up circuit is susceptible to noise such as power supply fluctuation, and thus, when used in portable devices whose power supply can possibly be cut off all of a sudden, it is difficult to ensure stable operation.

An embodiment is created in view of the above circumstances, and an object thereof is to provide a reference voltage generator circuit capable of stable generation of a reference voltage.

To solve the above problems, the embodiment provides a reference voltage generator circuit using a pair of PN junction devices with different current densities to generate a temperature-independent reference voltage.

Figure 1:
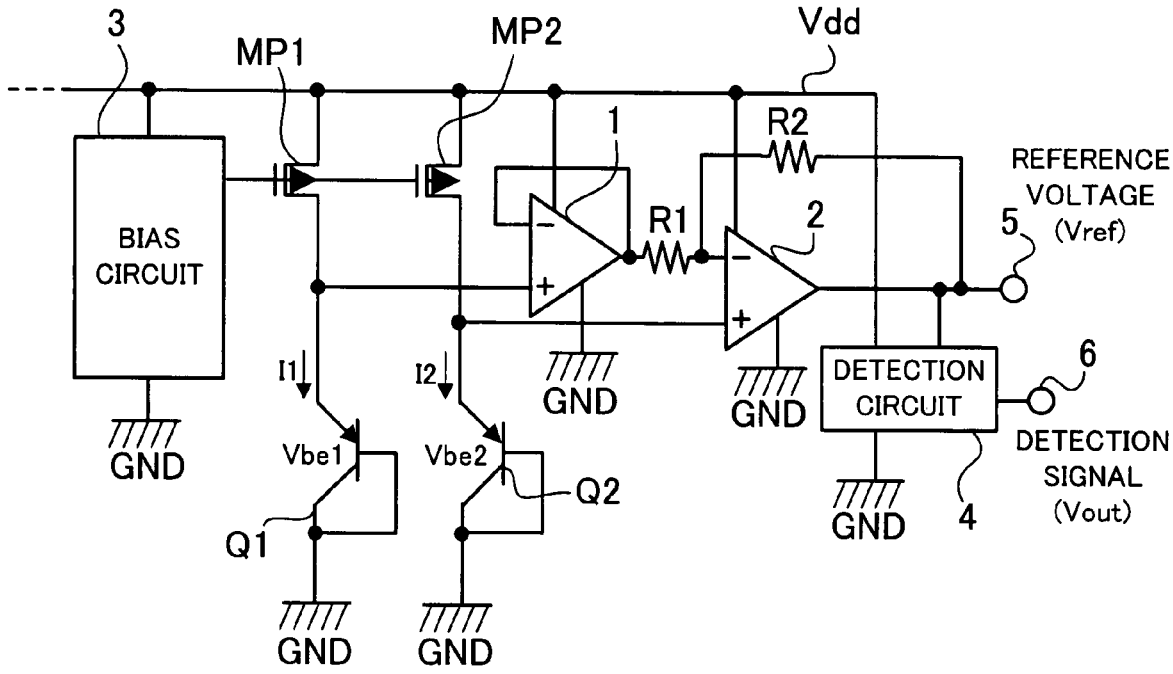
FIG. 1 is a circuit diagram of a reference voltage generator circuit according to an embodiment.

As shown in FIG. 1, the reference voltage generator circuit comprises a differential amplifier circuit 1 having a non-inverting input terminal input with a voltage (Vbe1) generated by one PN junction device (PNP transistor Q1 having its collector and base connected to each other) and an inverting input terminal input with an output signal thereof, and a differential amplifier circuit 2 having a non-inverting input terminal input with a voltage (Vbe2) generated by the other PN junction device (PNP transistor Q2 having its collector and base connected to each other) and an inverting input terminal input with the output signal of the differential amplifier circuit 1 through a resistor R1 and also input with an output signal thereof through a resistor R2, to generate a reference voltage.

With this configuration, the differential amplifier circuit 1 is input at the non-inverting input terminal with the voltage Vbe1 generated by the PNP transistor Q1 and is input at the inverting input terminal with the output signal thereof. The differential amplifier circuit 2 is input at the non-inverting input terminal with the voltage Vbe2 generated by the PNP transistor Q2 and is input at the inverting input terminal with the output signal of the differential amplifier circuit 1 through the resistor R1 and also with the output signal thereof through the resistor R2, to generate a reference voltage.

The reference voltage generator circuit of the embodiment uses a pair of PN junction devices with different current densities to generate a temperature-independent reference voltage and comprises a first differential amplifier circuit having a non-inverting input terminal input with a voltage generated by one of the PN junction devices and an inverting input terminal input with an output signal thereof, and a second differential amplifier circuit having a non-inverting input terminal input with a voltage generated by the other PN junction device and an inverting input terminal input with the output signal of the first differential amplifier circuit through a first resistor and also input with an output signal thereof through a second resistor, to generate a reference voltage. Since the output is not fed back to the non-inverting input terminal of the second differential amplifier circuit, the problem that the output is fixed at a voltage (e.g., 0 V) other than the reference voltage does not arise, making it unnecessary to provide a start-up circuit that makes the circuit operation unstable. It is therefore possible to generate a stable reference voltage having high tolerance to noise such as power supply fluctuation.

The above and other objects, features and advantages of the embodiment will become apparent from the following description when taken in conjunction with the accompanying drawings which illustrate preferred embodiments of the embodiment by way of example.

The embodiment will be described in detail below with reference to the accompanying drawings.

FIG. 1 is a circuit diagram of a reference voltage generator circuit according to the embodiment.

The reference voltage generator circuit of the embodiment includes PNP transistors Q1 and Q2 as a pair of PN junction devices with different emitter junction areas and different current densities, differential amplifier circuits 1 and 2, a bias circuit 3 for supplying a constant current, a detection circuit 4 for detecting generation of a reference voltage and generating a detection signal Vout, PMOS transistors MP1 and MP2 for supplying the constant current from the bias circuit 3 to the PNP transistors Q1 and Q2, respectively, and resistors R1 and R2.

Each of the PMOS transistors MP1 and MP2 has a source connected to a power supply line Vdd and a gate connected to the bias circuit 3 to be applied with a voltage set by the bias circuit 3. The drain of the PMOS transistor MP1 is connected to the emitter of the PNP transistor Q1, and the drain of the PMOS transistor MP2 is connected to the emitter of the PNP transistor Q2. Each of the PNP transistors Q1 and Q2 has its collector and base connected to each other, or diode-connected, and also connected to a ground terminal GND. The differential amplifier circuit 1 has a non-inverting input terminal connected to the node between the PMOS transistor MP1 and the PNP transistor Q1, and has an inverting input terminal connected to its own output terminal. The differential amplifier circuit 2 has a non-inverting input terminal connected to the node between the PMOS transistor MP2 and the PNP transistor Q2, and has an inverting input terminal connected to the output terminal of the differential amplifier circuit 1 through the resistor R1 and also connected to its own output terminal through the resistor R2. The output terminal of the differential amplifier circuit 2 is connected to a terminal 5 for outputting a reference voltage Vref. The detection circuit 4 is connected to the output terminal of the differential amplifier circuit 2 and, on detecting generation of the reference voltage Vref, generates a detection signal Vout to be output from a terminal 6.

Operation of the reference voltage generator circuit according to the embodiment will be now described.

When the voltage set by the bias circuit 3 is applied to the gates of the PMOS transistors MP1 and MP2, predetermined constant currents I1 and I2 flow to the PNP transistors Q1 and Q2, respectively. Of the base-emitter voltages Vbe1 and Vbe2 induced by the currents, the voltage Vbe1 is input to the non-inverting input terminal of the differential amplifier circuit 1 while the voltage Vbe2 is input to the non-inverting input terminal of the differential amplifier circuit 2. The output of the differential amplifier circuit 1 is fed back to its own inverting input terminal, so that the differential amplifier circuit 1 functions as a buffer. The output voltage of the differential amplifier circuit 1 is therefore equal to the voltage Vbe1. The differential amplifier circuit 2 outputs the reference voltage Vref when the voltages applied to its two input terminals are equal to each other. Since the input impedance of the differential amplifier circuit 2 is ideally infinite, the current flowing between the differential amplifier circuits 1 and 2 when the voltage applied to the inverting input terminal of the differential amplifier circuit 2 becomes equal to the voltage Vbe2 applied to the non-inverting input terminal due to the feedback fulfils the condition: (Vbe1−Vbe2)/R1=(Vbe2−Vref)/R2, and therefore, the reference voltage Vref is given by: Vref=Vbe2+(R2/R1)×(Vbe2−Vbe1). The voltages Vbe2 and (Vbe2−Vbe1) have opposite temperature dependences, and therefore, by setting the resistance ratio (R2/R1) to a suitable value, it is possible to cancel out the temperature coefficients and thus to obtain a temperature-independent reference voltage Vref.

In the reference voltage generator circuit of this embodiment, the output is not fed back to the non-inverting input terminal of the differential amplifier circuit 2, as seen from FIG. 1. Accordingly, the problem that the output is fixed at a voltage (e.g., 0 V) other than the reference voltage does not arise, making it unnecessary to use a start-up circuit that makes the circuit operation unstable. It is therefore possible to generate a stable reference voltage having high tolerance to noise such as power supply fluctuation.

The following describes in detail the bias circuit 3 of the embodiment.

Figure 2:
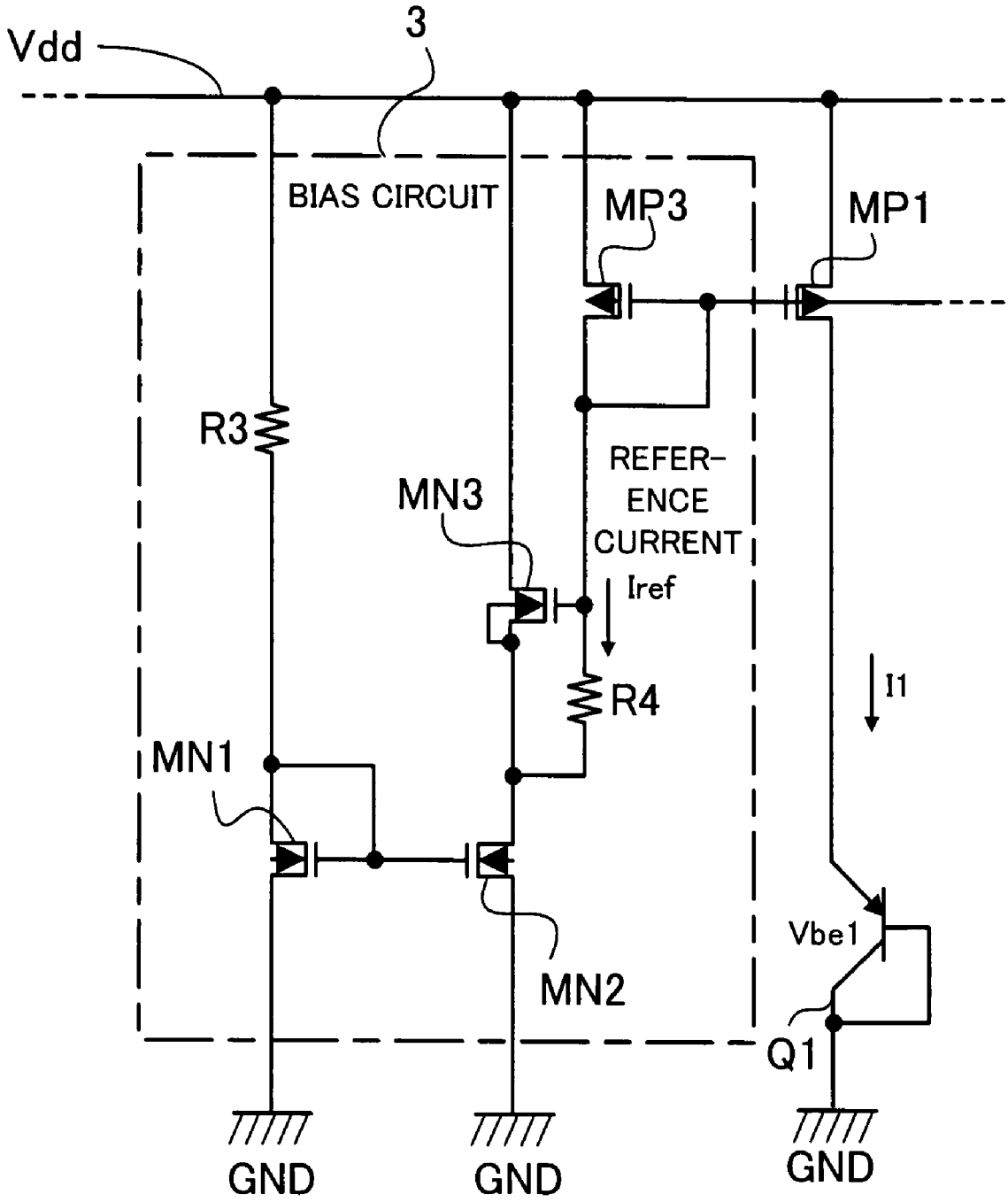
FIG. 2 is a circuit diagram of a bias circuit of FIG. 1.

FIG. 2 is a circuit diagram of the bias circuit according to the embodiment.

The bias circuit 3 of the embodiment is constituted by NMOS transistors MN1, MN2 and MN3, a PMOS transistor MP3, and resistors R3 and R4.

The NMOS transistor MN1 has a drain connected through the resistor R3 to the power supply line Vdd, has a source connected to the ground terminal GND, and has a gate connected to the gate of the NMOS transistor MN2 as well as to its own drain. The NMOS transistor MN2 has a drain connected to the source of the NMOS transistor MN3 and a source connected to the ground terminal GND.

The NMOS transistor MN3 has a drain connected to the power supply line Vdd and a source connected to the drain of the NMOS transistor MN2. The gate of the NMOS transistor MN3 is connected to the drain of the PMOS transistor MP3, which constitutes a current mirror circuit, as well as to its own source through the resistor R4. The NMOS transistor MN3 has its substrate connected to the source of its own. The PMOS transistor MP3 has a source connected to the power supply line Vdd and a gate connected to its own drain as well as to the gates of the aforementioned PMOS transistors MP1 and MP2. The current mirror circuit is constituted by the PMOS transistors MP1, MP2 and MP3.

Figure 8:
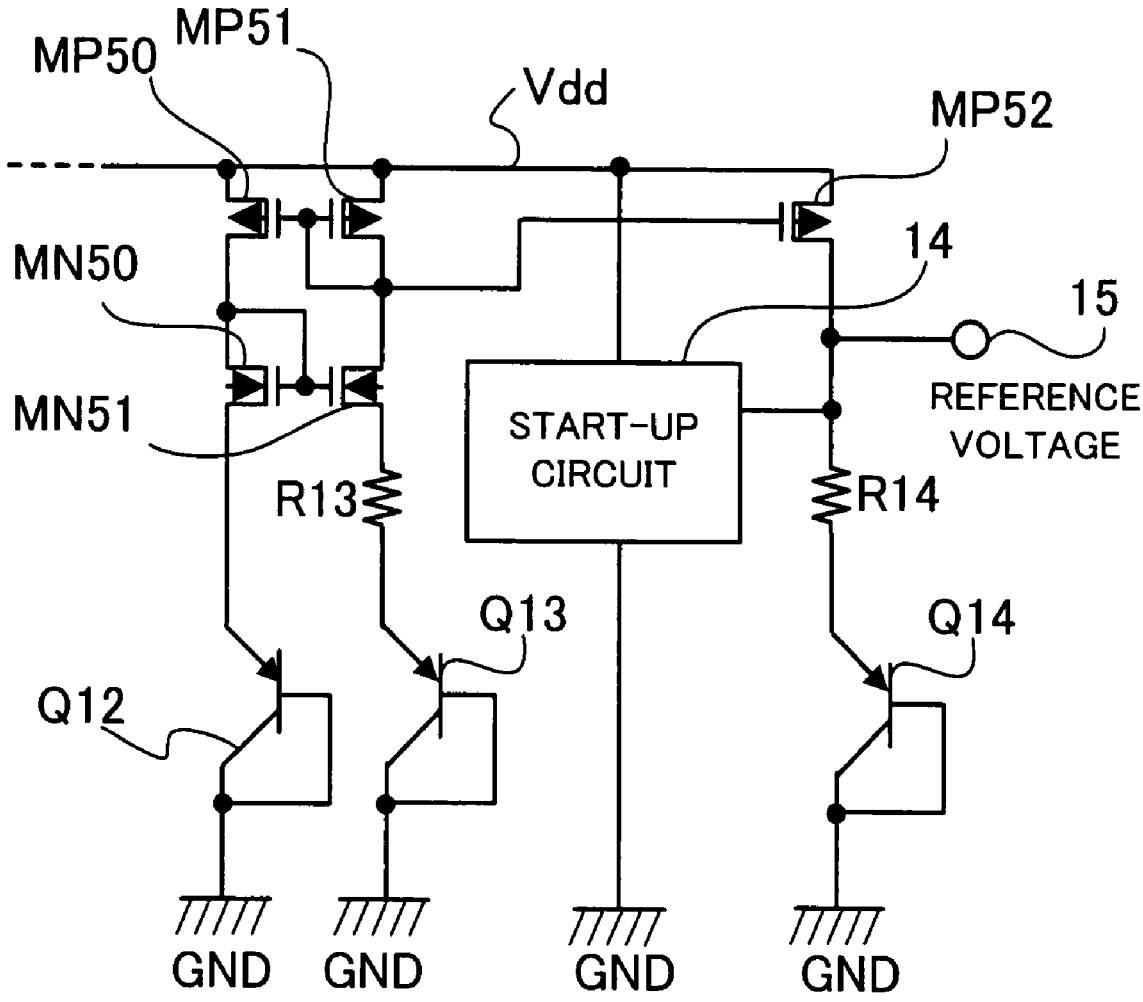
FIG. 8 PRIOR ART
FIG. 8 is a circuit diagram exemplifying another conventional reference voltage generator circuit (second type).

In the bias circuit 3 configured as above, the source of the NMOS transistor MN3 is controlled by the NMOS transistors MN1 and MN2, which also constitute a current mirror circuit, so that a constant current may flow. A reference current Iref flowing to the resistor R4 is given by: Iref=Vgs/R4 (Vgs is the gate-source voltage of the NMOS transistor MN3). The reference current Iref is taken out by the current mirror circuit constituted by the PMOS transistors MP1, MP2 and MP3 to obtain the aforementioned constant currents I1 and I2. As the supply voltage rises and the reference current Iref increases, the voltage drop at the resistor R4 connected between the gate and source of the NMOS transistor MN3 increases, with the result that the NMOS transistor MN3 switches on. Thus, even if the supply voltage further rises thereafter, the drain current of the NMOS transistor MN3 increases but the reference current Iref flowing through the bias current mirror circuit is restrained from increasing. Unlike the conventional reference voltage generator circuit of FIG. 8 in which the PMOS transistors MP50 and MP51 and the NMOS transistors MN50 and MN51 are series-connected, the bias circuit 3 of this embodiment does not require such series connection and thus can be operated at a low voltage.

Figure 3:
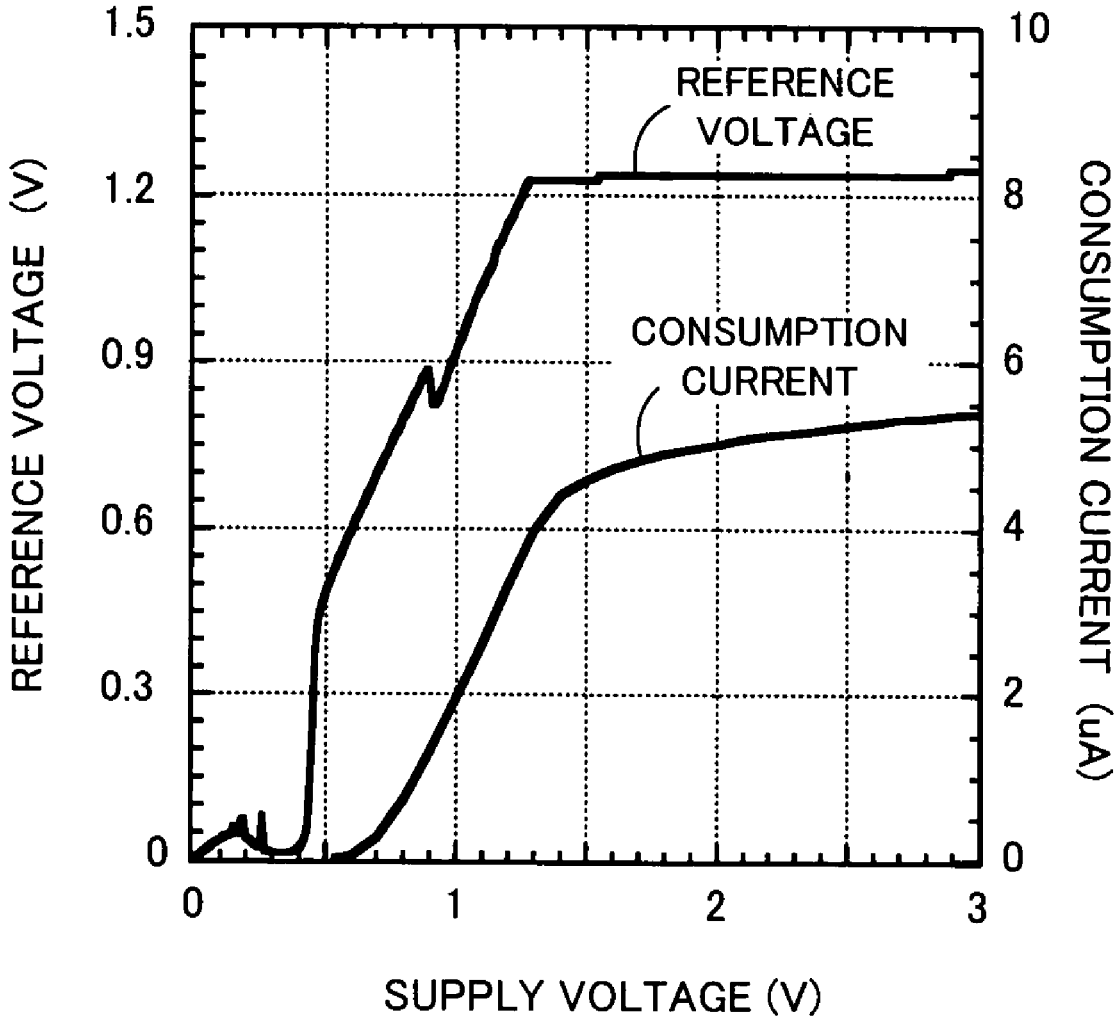
FIG. 3 shows the dependence of consumption current on supply voltage according to the embodiment.

FIG. 3 shows the dependence of consumption current on supply voltage.

In the figure, the horizontal axis indicates the supply voltage VDD, and the vertical axes indicate the reference voltage and the consumption current. The figure shows that even if the supply voltage VDD rises, the consumption current of the reference voltage generator circuit is restrained from increasing, proving that the reference voltage generator circuit can be operated with low power over a wider voltage range.

Also, the bias circuit 3 uses no bipolar transistors and is constituted by MOS transistors only, whereby space can be saved.

The detection circuit 4 of this embodiment will be now described in detail.

Figure 4:
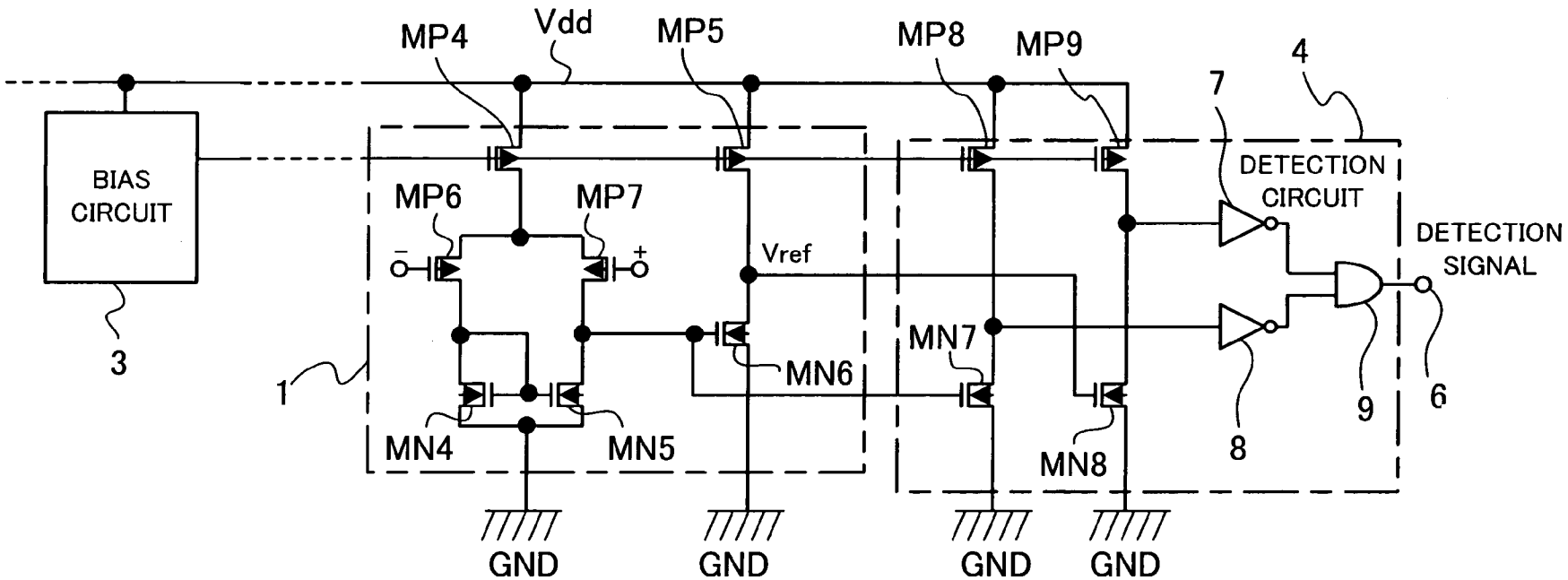
FIG. 4 is a circuit diagram of a detection circuit of FIG. 1.

FIG. 4 is a circuit diagram of the detection circuit.

The figure also shows a detailed circuit configuration of the differential amplifier circuit 2 for outputting the reference voltage, shown in FIG. 1.

The differential amplifier circuit 2 includes PMOS transistors MP4 and MP5 supplied with the constant current from the bias circuit 3, PMOS transistors MP6 and MP7 and NMOS transistors MN4 and MN5 constituting a differential amplifier, and an NMOS transistor MN6 constituting an output circuit. The PMOS transistors MP4 and MP5 have their sources connected to the power supply line Vdd. The drain of the PMOS transistor MP4 is connected to the sources of the PMOS transistors MP6 and MP7, and the drain of the PMOS transistor MP5 is connected to the drain of the NMOS transistor MN6. The drain of the PMOS transistor MP6 is connected to the drain of the NMOS transistor MN4, and the drain of the PMOS transistor MP7 is connected to the drain of the NMOS transistor MN5. The gate of the PMOS transistor MP6 is connected to the inverting input terminal, and the gate of the PMOS transistor MP7 is connected to the non-inverting input terminal. The resistor R1 and the PNP transistor Q2 shown in FIG. 1 are connected to these input terminals but are not shown in the figure. The gates of the NMOS transistors MN4 and MN5 are connected to each other and are also connected to the drain of the NMOS transistor MN4. The sources of the NMOS transistors MN4 and MN5 are connected to the ground terminal GND. The output of the differential amplifier is derived from the drain of the NMOS transistor MN5 and input to the gate of the NMOS transistor MN6 as the output circuit. The source of the NMOS transistor MN6 is connected to the ground terminal GND. The output of the differential amplifier circuit 2 is derived from the drain of the NMOS transistor MN6.

The detection circuit 4 is constituted by PMOS transistors MP8 and MP9 supplied with the constant current from the bias circuit 3, NMOS transistors MN7 and MN8, inverters 7 and 8, and an AND gate 9.

The PMOS transistors MP8 and MP9 have their sources connected to the power supply line Vdd. The drain of the PMOS transistor MP8 is connected to the drain of the NMOS transistor MN7, and the drain of the PMOS transistor MP9 is connected to the drain of the NMOS transistor MN8. The NMOS transistor MN7 has a source connected to the ground terminal GND and a gate connected to the gate of the NMOS transistor MN6 of the differential amplifier circuit 2. The NMOS transistor MN8 has a source connected to the ground terminal GND and a gate input with the reference voltage Vref from the differential amplifier circuit 2. The input terminal of the inverter 7 is connected to the drain of the NMOS transistor MN8, and the input terminal of the inverter 8 is connected to the drain of the NMOS transistor MN7. The outputs of the inverters 7 and 8 are input to the AND gate 9, the output terminal of which is connected to the terminal 6 for outputting the detection signal.

With the circuit configuration described above, when the gate potentials of the PMOS transistors MP6 and MP7 of the differential amplifier circuit 2 become equal to each other, the aforementioned reference voltage Vref is derived from the drain of the NMOS transistor MN6 as the output circuit. Since at this time the NMOS transistor MN6 is switched on, the detection signal can be formed by suitably selecting the transistor size of the NMOS transistor MN7 of the detection circuit 4 and the logic level of the inverter 8. In order to avoid malfunction, the detection circuit 4 is configured to provide the detection signal by detecting the output reference voltage Vref with the NMOS transistor MN8 and then subjecting the consequent output potential of the inverter 7 and the output potential of the inverter 8 to AND operation.

Figure 5:
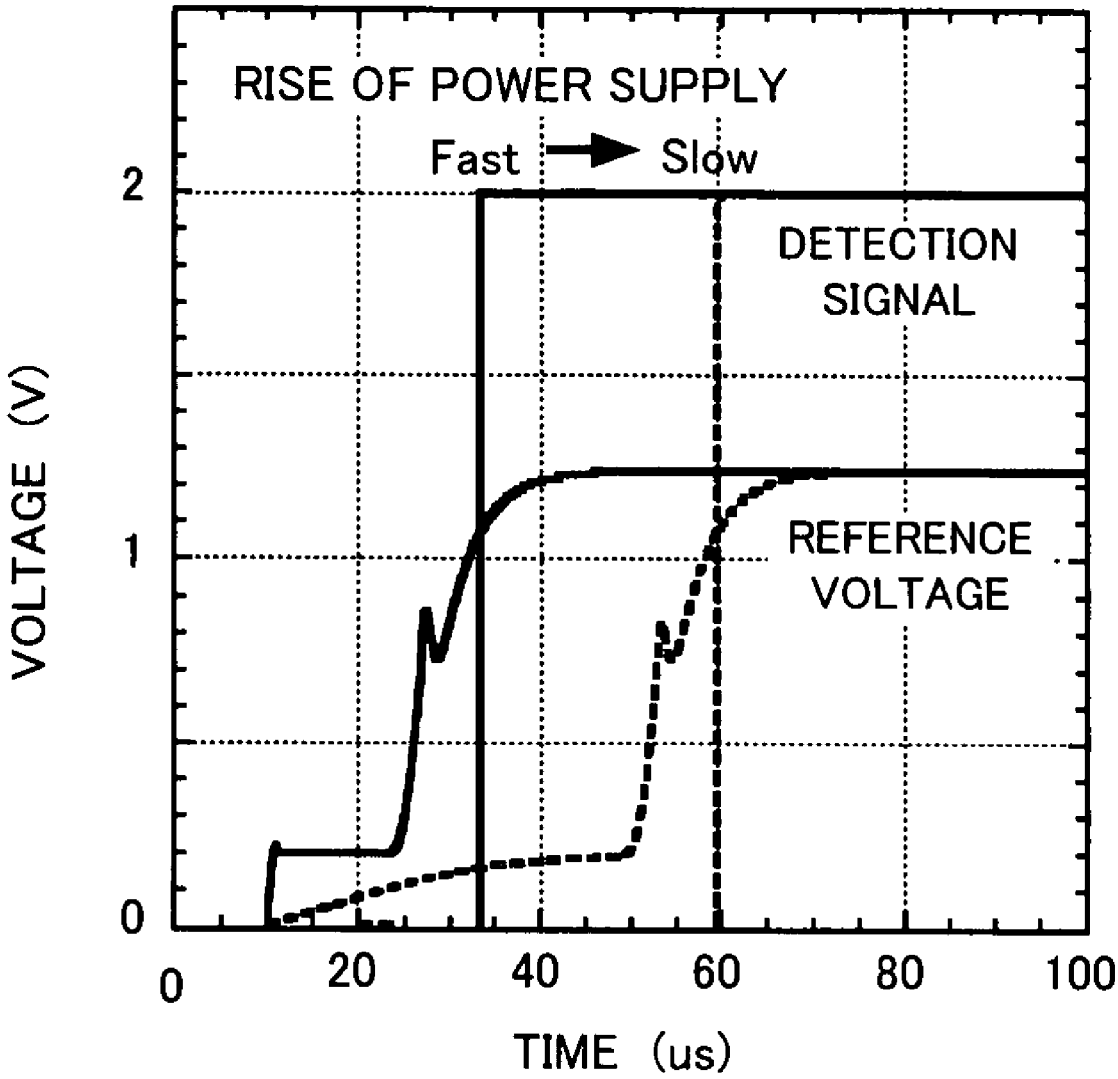
FIG. 5 shows transient characteristics of a reference voltage and a detection signal according to the embodiment.

FIG. 5 shows the transient characteristic of the reference voltage and of the detection signal.

In the figure, the horizontal axis indicates time, and the vertical axis indicates voltage.

The figure shows two sets of transient characteristics of the reference voltage and the detection signal relative to the rise time of power supply, wherein the solid lines indicate the transient characteristics observed when the rise of power supply is fast and the dashed lines indicate the transient characteristics observed when the rise of power supply is slow. As seen from the figure, in either case, the detection signal turns to H (High) level following the rise of the reference voltage.

Figure 6:
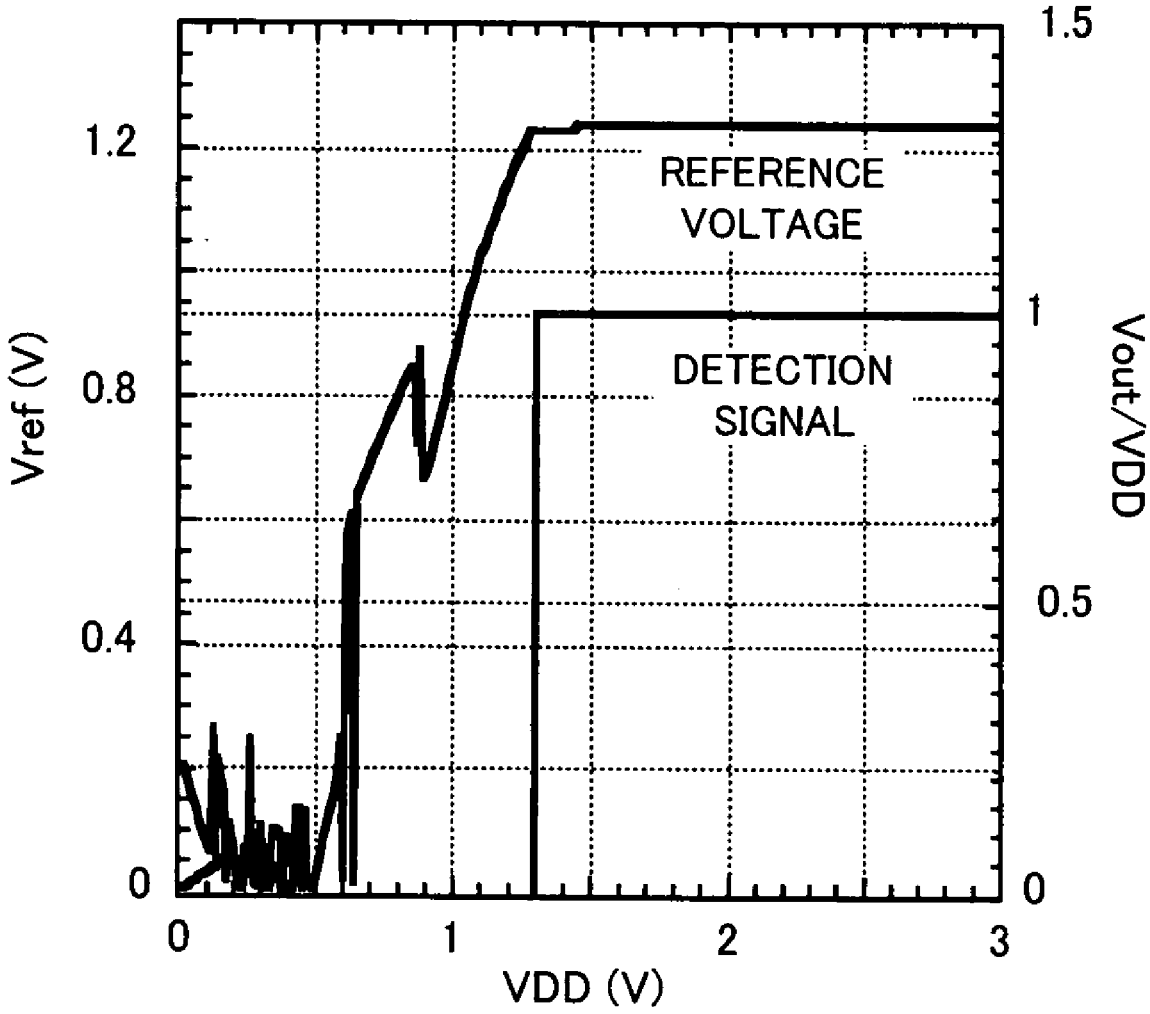
FIG. 6 shows a DC characteristic of the detection signal according to the embodiment.
Figure 7:
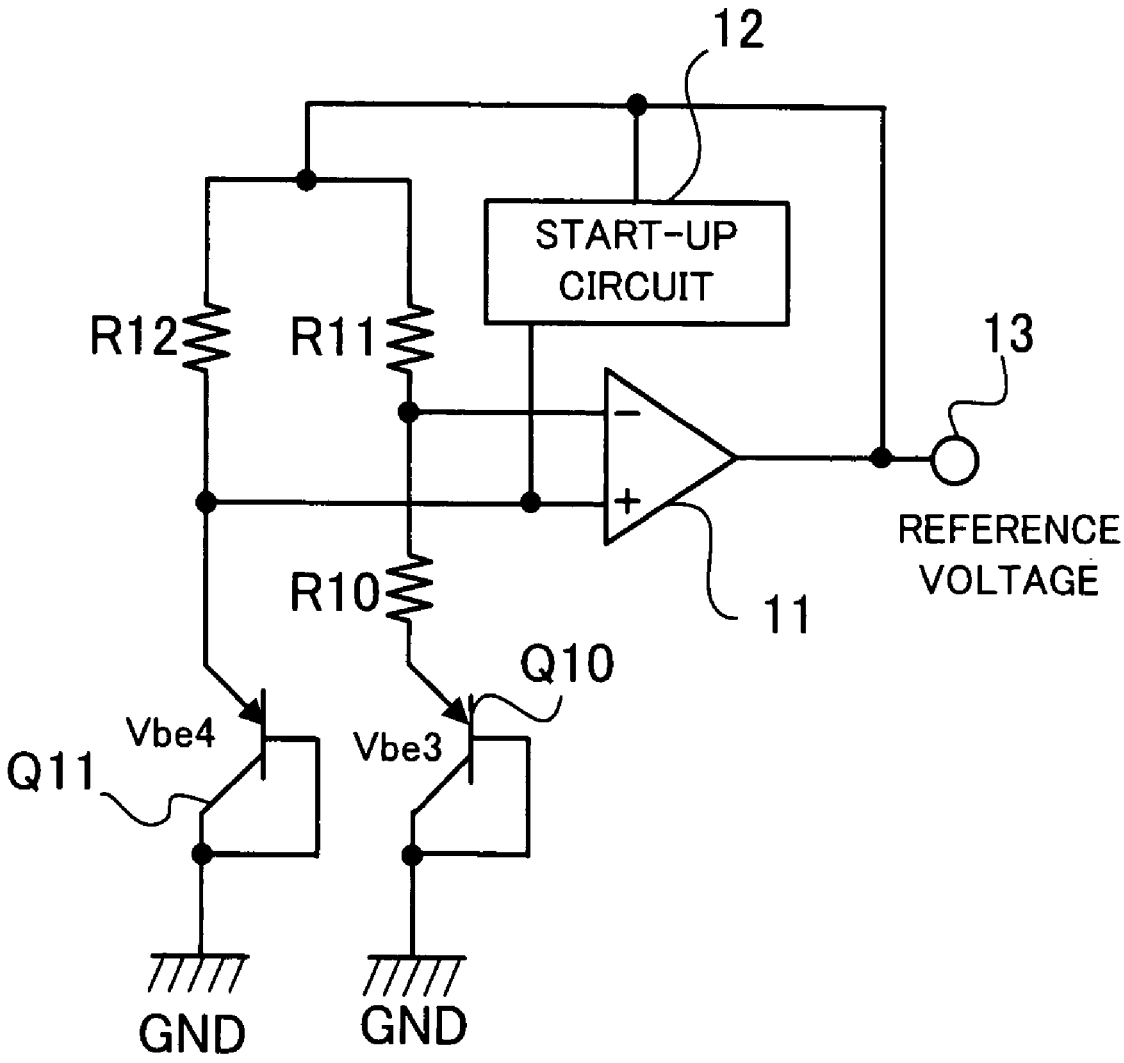
FIG. 7 PRIOR ART
FIG. 7 is a circuit diagram exemplifying a conventional reference voltage generator circuit (first type).

FIG. 6 shows a DC characteristic of the detection signal.

In the figure, the horizontal axis indicates the supply voltage VDD, and the vertical axes indicate the reference voltage Vref and the detection signal Vout/VDD.

As seen from the figure, the detection signal turns to H level at the supply voltage VDD level as low as 1.3 V, for example. The detection signal may be used as a power-on reset signal for initializing the internal circuit elements at the time the semiconductor integrated circuit is powered on, whereby operation at low voltage can be ensured.

In this manner, the reference voltage generator circuit according to the embodiment operates at low voltage, has high tolerance to noise such as voltage fluctuation, and is capable of operating with low power over a wide voltage range. Thus, the reference voltage generator circuit possesses all the necessary characteristics for semiconductor integrated circuits used in IC cards, ID chips, or portable devices.

The present invention is not limited to the above embodiment alone and may be modified in various ways without departing from the scope of the claims. For example, although the foregoing embodiment uses the PNP transistors Q1 and Q2 whose bases are connected to their respective collectors, it is also possible to use NPN transistors whose bases are connected to their respective collectors, or diodes.

The foregoing is considered as illustrative only of the principles of the embodiment. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A reference voltage generator circuit to generate a reference voltage, comprising:

a first PN junction device having a first current density;

a second PN junction device having a second current density different from the first current density;

a first differential amplifier circuit having a non-inverting input terminal coupled to a voltage generated by the first PN junction device, and an inverting input terminal coupled to an output signal of the first differential amplifier circuit;

a second differential amplifier circuit having a non-inverting input terminal coupled to a voltage generated by the second PN junction device, and an inverting input terminal coupled to the output signal of the first differential amplifier circuit through a first resistor and also coupled to an output signal of the second differential amplifier circuit through a second resistor, to generate the reference voltage; and a detection circuit for detecting generation of the reference voltage.

2. The reference voltage generator circuit according to claim 1, wherein the reference voltage Vref is given by: $Vref=V2+(R2/R1)\times(V2-V1)$, where V1 is the voltage generated by the first PN junction device, V2 is the voltage generated by the second PN junction device, R1 is the resistance of the first resistor, and R2 is the resistance of the second resistor.

3. The reference voltage generator circuit according to claim 1, wherein the first and second PN junction devices comprises a PNP bipolar transistor having a collector and a base connected to each other.

4. The reference voltage generator circuit according to claim 1, wherein the detection circuit outputs a power-on reset signal upon when the detection circuit detects the generation of the reference voltage.

5. The reference voltage generator circuit according to claim 1, further comprising a bias circuit including an n-channel MOS field-effect transistor, the n-channel MOS field-effect transistor having a substrate connected to a source of the n-channel MOS field-effect transistor, a drain connected to a power supply, and a gate connected to a current mirror circuit and also connected through a third resistor to the source of the n-channel MOS field-effect transistor, wherein, in the bias circuit, a current of the source is controlled constant and a current flowing to the third resistor is derived by the current mirror circuit to supply a constant current.

* * * * *